US009963826B2

(12) United States Patent
Higuchi

(10) Patent No.: US 9,963,826 B2
(45) Date of Patent: May 8, 2018

(54) SHEET MANUFACTURING APPARATUS

(71) Applicant: SEIKO EPSON CORPORATION, Tokyo (JP)

(72) Inventor: Naotaka Higuchi, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 148 days.

(21) Appl. No.: 14/952,087

(22) Filed: Nov. 25, 2015

(65) Prior Publication Data

US 2016/0145803 A1 May 26, 2016

(30) Foreign Application Priority Data

Nov. 26, 2014 (JP) ..... 2014-238484

(51) Int. Cl.
*D21F 1/60* (2006.01)
*D04H 1/736* (2012.01)

(52) U.S. Cl.
CPC ..... *D21F 1/60* (2013.01); *D04H 1/736* (2013.01)

(58) Field of Classification Search
CPC ..... D21F 1/52; D21F 1/60; D21F 9/04; D21F 9/046; D04H 1/72; D04H 1/732; D04H 1/736
USPC ..... 162/318, 357; 19/307; 425/80.1, 81.1, 425/82.1, 83.1
See application file for complete search history.

(56) References Cited

U.S. PATENT DOCUMENTS

| | | | | |
|---|---|---|---|---|
| 3,010,161 | A | 11/1961 | Duvall | |
| 4,640,810 | A * | 2/1987 | Laursen | D04H 1/732 264/121 |
| 7,947,203 | B2 | 5/2011 | Niiranen | |
| 2003/0010683 | A1 * | 1/2003 | Christensen | B27N 3/14 209/683 |
| 2004/0234638 | A1 | 11/2004 | Thordahl | |
| 2014/0027075 | A1 | 1/2014 | Yamagami et al. | |
| 2014/0374047 | A1 | 12/2014 | Yamagami | |
| 2016/0305066 | A1 * | 10/2016 | Miyazawa | D21B 1/06 |
| 2017/0037550 | A1 * | 2/2017 | Miyazawa | D04H 1/732 |

FOREIGN PATENT DOCUMENTS

| | | |
|---|---|---|
| JP | 2003-520912 | 7/2003 |
| JP | 2012-144819 | 8/2012 |
| JP | 2015-120999 | 7/2015 |

* cited by examiner

*Primary Examiner* — Eric Hug
(74) *Attorney, Agent, or Firm* — Workman Nydegger

(57) ABSTRACT

A sheet manufacturing apparatus includes a rotatable drum unit that includes an opening section having a plurality of openings on a surface thereof and a cylindrical section having no opening; a material supply unit that is provided to supply a material containing fibers to the drum unit by airflow; and a forming unit that forms a sheet by using the material passing through the openings, in which at least one of the drum unit and the material supply unit has a diffusion section in which airflow is diffused further on a downstream side than on an upstream side in a supply direction of the airflow.

6 Claims, 8 Drawing Sheets

SHEET MANUFACTURING APPARATUS

BACKGROUND

1. Technical Field

The present invention relates to a sheet manufacturing apparatus.

2. Related Art

In the related art, a paper recycling apparatus including a paper forming machine has been known. The paper forming machine has a forming drum in which a small-hole screen is provided and a rotatable needle roll that is provided within the forming drum, and is configured to disperse fibers introduced into the forming drum into the atmosphere (for example, see JP-A-2012-144819).

However, if airflow for introducing the fibers is not sufficiently diffused within the forming drum, there is a problem that variation of an airflow speed is increased within the forming drum, the fibers are caught by the small-hole screen, and portions that cannot discharge the fibers from the forming drum are generated. Furthermore, there is a problem that the fibers are easily caught in an outer periphery portion of the drum in the portions that cannot discharge the fibers, the caught fibers are accumulated or fall, and texture of a sheet is deteriorated.

SUMMARY

The invention can be realized in the following aspects or application examples.

Application Example 1

According to this application example, there is provided a sheet manufacturing apparatus including a rotatable drum unit that includes an opening section having a plurality of openings on a surface thereof and a tubular unit having no opening; a material supply unit that is provided to supply a material containing fibers to the drum unit by airflow; and a forming unit that forms a sheet by using the material passing through the openings. At least one of the drum unit and the material supply unit has a diffusion section in which airflow is diffused further on a downstream side than on an upstream side in a supply direction of the airflow.

In this case, the diffusion section is provided in the drum unit or the material supply unit and the introduced airflow is diffused to a peripheral surface of the drum unit by the diffusion section. Then, the material is also efficiently dispersed according to the diffused airflow in the drum unit or the material supply unit. Thus, it is possible to reduce a portion through which the material does not pass in the drum unit.

Application Example 2

In the sheet manufacturing apparatus according to the above application example, the diffusion section may be an enlarged part of which a cross-sectional area on the downstream side is greater than a cross-sectional area on the upstream side of the material supply unit.

In this case, the airflow is introduced within the drum unit while being diffused by increasing the cross-sectional area of the material supply unit on the downstream side. Thus, the material is efficiently dispersed in the drum unit and it is possible to reduce a portion through which the material does not pass.

Application Example 3

In the sheet manufacturing apparatus according to the above application example, the diffusion section may be a changing section that changes a direction of the airflow within the drum unit.

In this case, a direction of the airflow introduced from the material supply unit is changed by the changing section within the drum unit. That is, the airflow is diffused within the drum unit. Thus, the material is efficiently dispersed in the drum unit and it is possible to reduce the portion through which the material does not pass.

Application Example 4

In the sheet manufacturing apparatus according to the above application example, a supply port of the material supply unit may be positioned in a position in which the airflow is diffused with respect to the opening section within the drum unit.

In this case, the supply port of the material supply unit is positioned in the position in which the airflow is diffused within the drum unit. Thus, the airflow is introduced within the drum unit while being diffused. Thus, the material is efficiently dispersed in the drum unit and it is possible to reduce the portion through which the material does not pass.

Application Example 5

The sheet manufacturing apparatus according to the above application example may further include a housing unit that surrounds a periphery of the drum unit; and a suction unit that sucks air within the housing unit below the drum unit, in which outside air may be suctioned from a sliding contact part between the drum unit and the housing unit during suction by the suction unit.

In this case, the outside air is suctioned from the sliding contact part between the drum unit and the housing unit in addition to the diffusion of the airflow by the diffusion section. Thus, the airflow is further diffused by the suctioned outside air within the drum unit. It is possible to efficiently disperse the material within the drum unit.

Application Example 6

According to this application example, there is provided a sheet manufacturing apparatus including a housing unit that surrounds a periphery of a drum unit; and a suction unit that sucks air within the housing unit below the drum unit. Outside air is suctioned from a sliding contact part between the drum unit and the housing unit during suction by the suction unit.

In this case, the outside air is suctioned from the sliding contact part between the drum unit and the housing unit. Thus, lumps, aggregation, and the like of the material within the drum unit or the housing unit are reduced and texture of the sheet is improved.

In the sheet manufacturing apparatus according to Application Examples 5 and 6, the sliding contact part between the drum unit and the housing unit is a seal member for sealing a gap between the drum unit and the housing unit. Furthermore, the outside air may be suctioned from the gap without providing the seal member.

Application Example 7

According to this application example, there is provided a sheet manufacturing apparatus including a rotatable drum unit that is a hollow cylindrical drum unit and includes an opening section having a plurality of openings; a supply unit that includes a supply port for supplying a material containing fibers transported by airflow to the drum unit; and a forming unit that forms a sheet by using the material passing through the openings of the drum unit. The supply port is disposed at a predetermined distance with respect to the opening section of the drum unit in a rotation axis direction of the drum unit. A diameter of the supply port is smaller than an internal diameter of the drum unit.

In this case, it is preferable that the supply port is disposed such that, for example, a center of an inner diameter thereof is positioned in the rotation axis direction of the drum unit.

Application Example 8

According to this application example, there is provided a sheet manufacturing apparatus including a rotatable drum unit that includes an opening section having a plurality of openings and a tubular section having no opening; a supply unit that supplies a material containing fibers to the drum unit; a transport path that communicates with the supply unit and transports the material containing the fibers to the supply unit by the airflow; and a forming unit that forms a sheet by using the material passing through the openings of the drum unit. The drum unit has a receiving port for receiving the material. The supply unit has a supply port for supplying the material to the drum unit. The supply port is disposed at a predetermined distance with respect to the receiving port in a rotation axis direction of the drum unit. An area of the supply port is smaller than an area of the receiving port.

A predetermined distance is provided between the supply port and the receiving port, and the receiving port is greater than the supply port in size. Thus, it is possible to diffuse the airflow transporting the material from the supply port to the receiving port.

Here, the receiving port of the drum unit is, for example, a boundary portion between the tubular section and the opening section. More specifically, the receiving port is an inner circumference portion of the drum unit drawing on a virtual plane perpendicular to a rotation axis of the drum unit through the boundary between the tubular section and the opening section. Furthermore, an area of the supply port and an area of the receiving port are, for example, a cross-sectional area in a direction perpendicular to the rotation axis of the drum unit.

Application Example 9

According to this application example, there is provided a sheet manufacturing apparatus including a rotatable drum unit that includes an opening section having a plurality of openings and a cylindrical section having no opening; a supply unit for supplying a material containing fibers to the drum unit; a transport path that communicates with the supply unit and transports the material containing the fibers to the supply unit by the airflow; a diffusion section that is provided at least one of the drum unit and the supply unit, and diffuses airflow transporting the material containing the fibers; and a forming unit that forms a sheet by using the material passing through the openings of the drum unit.

Here, when the diffusion section is provided in the supply unit, for example, a portion of which a cross-sectional area (cross-sectional area in a direction perpendicular to a flow direction of the airflow) from the transport path side to the drum unit side in the supply unit becomes large can be the diffusion section. Moreover, the entirety of the supply unit may be the diffusion section.

Furthermore, when the diffusion section is provided in the drum unit, for example, a plate member that is in the drum unit and is disposed in a position facing the supply unit can be the diffusion section. The plate member may be a flat plate, a curved shape, or a bent shape, and a shape thereof is not limited when a shape of the plate member can diffuse the airflow.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, first to fourth embodiments of the invention will be described with reference to the drawings. Moreover, in each view below, scales of each member and the like are illustrated differently from real scales to make each member and the like be recognizable sizes.

First Embodiment

First, a configuration of a sheet manufacturing apparatus will be described. The sheet manufacturing apparatus is, for example, based on a technique of forming a new sheet Pr from a raw material (material to be defibrated) Pu such as pure pulp sheets and used paper. The sheet manufacturing apparatus according to the embodiment includes a rotatable drum that includes an opening section having a plurality of openings on a surface thereof and a cylindrical section having no opening; a material supply unit for supplying a material containing fibers to the drum by airflow; and a forming unit that forms a sheet by using the material passing through the openings. At least one of the drum and the material supply unit has a diffusion section in which airflow is diffused further on a downstream side than on an upstream side in a supply direction of the airflow. Hereinafter, the detailed configuration of the sheet manufacturing apparatus will be described.

Figure 1:
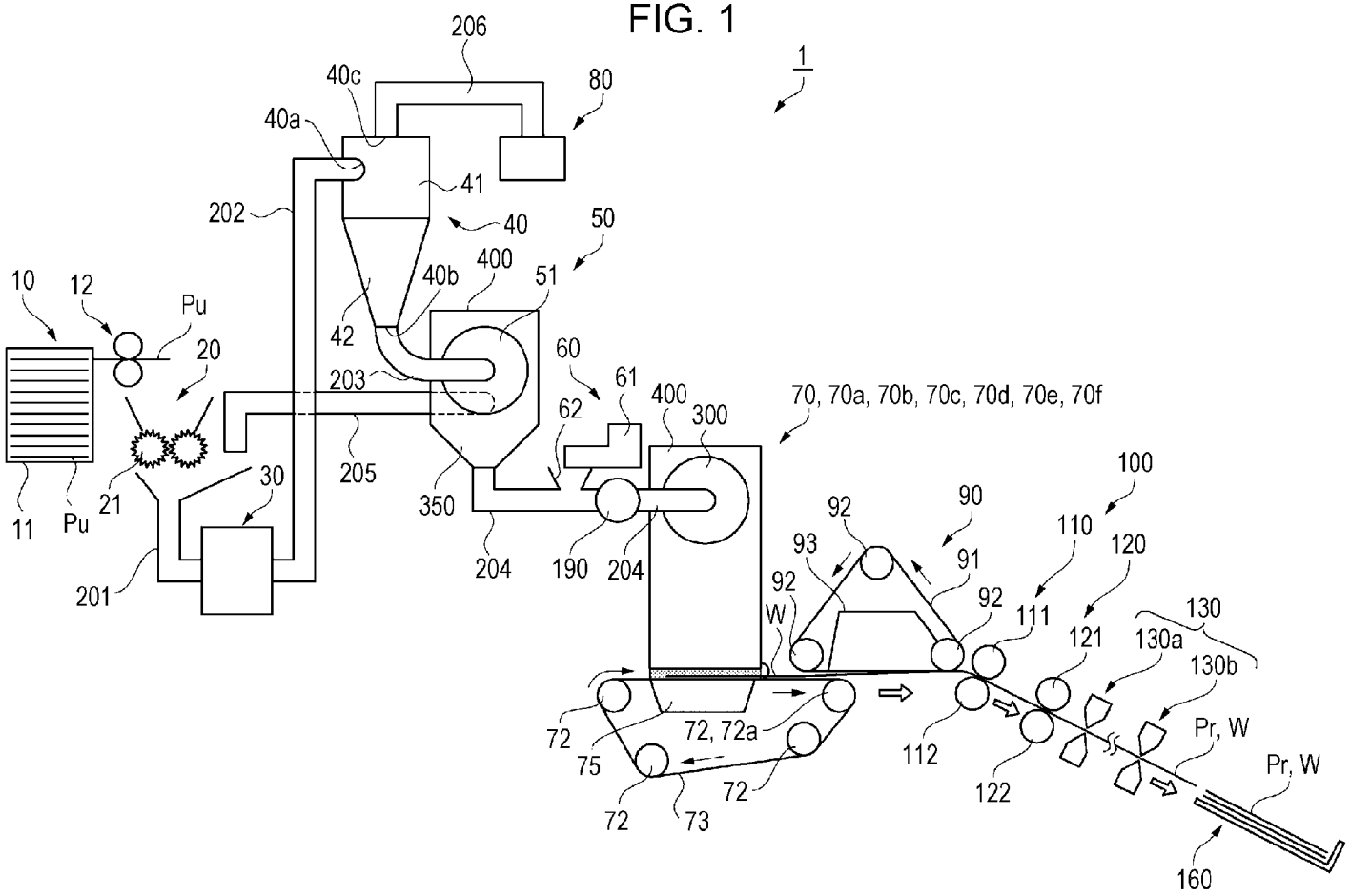
FIG. 1 is a schematic view illustrating a configuration of a sheet manufacturing apparatus according to a first embodiment.

FIG. 1 is a schematic view illustrating the configuration of the sheet manufacturing apparatus according to the embodiment. As illustrated in FIG. 1, a sheet manufacturing apparatus 1 of the embodiment includes a supply unit 10, a crushing unit 20, a defibrating unit 30, a classifying unit 40, a screening unit 50, an additive feeding unit 60, a blower 190, an accumulation unit 70, a forming unit 100, and the like.

The supply unit 10 is provided for supplying a used paper Pu as the raw material to the crushing unit 20. The supply unit 10 includes, for example, a tray 11 in which a plurality of used papers Pu are overlapped and stored, an automatic feeding mechanism 12 capable of continuously feeding the used papers Pu in the tray 11 into the crushing unit 20, and the like. The used paper Pu supplied to the sheet manufacturing apparatus 1 is, for example, paper of A4 size and the like mainly used in an office.

The crushing unit 20 cuts supplied used paper Pu to paper pieces of several centimeters square. The crushing unit 20 includes crushing blades 21 and configures a device for spreading cut widths of blades of a conventional shredder. Thus, it is possible to easily cut the supplied used paper Pu to the paper pieces. Then, cut paper pieces (crushed papers) are supplied to the defibrating unit 30 through a pipe 201.

The defibrating unit 30 defibrates a material containing fibers in the atmosphere. Specifically, the defibrating unit 30 includes rotating rotary blades (not illustrated) and performs defibration to untangle the crushed papers supplied from the crushing unit 20 in fibriform. In the present application, what is defibrated by the defibrating unit 30 is referred to as the material to be defibrated and what passes through the defibrating unit 30 is referred to as the defibrated material. Moreover, the defibrating unit 30 of the embodiment is a dry type and performs defibration in the atmosphere. Coating materials (for example, blur-preventing agent) to the paper such as ink and toner, and the like to be printed are separated from the fiber by being particles (hereinafter, referred to as "ink particles") of several tens of μm or less by the defibrating process of the defibrating unit 30. Thus, the defibrated material drawn out from the defibrating unit 30 is fiber and the ink particles obtained by defibration of the paper pieces. Then, a mechanism of generating airflow by rotation of the rotary blades is provided and the defibrated fiber is transported to the classifying unit 40 in the atmosphere through a pipe 202 by riding on the airflow. Moreover, an airflow generating device for generating the airflow to transport the defibrated fiber to the classifying unit 40 through the pipe 202 may be separately provided in the defibrating unit 30 when required.

The classifying unit 40 classifies an introduced material that is introduced by the airflow. In the embodiment, the defibrated material as the introduced material is classified into the ink particles and the fiber. The classifying unit 40 can classify the transported defibrated material into the ink particles and the fiber by using the airflow, for example, by applying a cyclone. Moreover, another airflow type classifier may be used instead of the cyclone. In this case, as the airflow type classifier other than the cyclone, for example, elbow jet, eddy classifier, and the like are used. The airflow type classifier generates a whirling airflow, separates, and classifies the defibrated material by a difference in a centrifugal force received by a size and density of the defibrated material. Thus, it is possible to adjust a classification point by adjusting a speed of the airflow and the centrifugal force. Thus, the defibrated material is separated into small ink particles of relatively low density and the fiber of high density having particles greater than the ink particles in size.

The classifying unit 40 of the embodiment is a tangent input type cyclone and is configured of an inlet 40*a* through which the introduced material is introduced from the defibrating unit 30, a cylindrical section 41 to which the inlet 40*a* is attached in a tangent direction, a conical unit 42 following a lower portion of the cylindrical section 41, a lower outlet 40*b* provided in a lower portion of the conical unit 42, and an upper air outlet 40*c* for discharging fine powder provided in an upper center of the cylindrical section 41. A diameter of the conical unit 42 is decreased going downward in a vertical direction.

In a classifying process, the airflow, on which the defibrated material introduced from the inlet 40*a* of the classifying unit 40 rides, is changed to a circumferential movement in the cylindrical section 41 and the conical unit 42, and the defibrated material is classified by applying the centrifugal force. Then, the fiber that is greater than the ink particles in size and has a high density moves to the lower outlet 40*b* and the ink particles that are relatively small and have a low density are guided to the upper air outlet 40*c* as fine powder together with air. Then, the ink particles are discharged from the upper air outlet 40*c* of the classifying unit 40. Then, the discharged ink particles are recovered in a receiving unit 80 through a pipe 206 connected to the upper air outlet 40*c* of the classifying unit 40. On the other hand, a classified material containing the classified fiber is transported from the lower outlet 40*b* of the classifying unit 40 to the screening unit 50 through a pipe 203 in the atmosphere. The classified material may be transported from the classifying unit 40 to the screening unit 50 by the airflow when being classified or may be transported from the classifying unit 40 that is present in an upper portion to the screening unit 50 that is present in a lower portion by gravity. Moreover, a suction unit for efficiently suctioning a short fiber mixture from the upper air outlet 40*c* and the like may be provided in the upper air outlet 40*c* of the classifying unit 40, the pipe 206, and the like. Classification is not intended to accurately divide the defibrated material by a certain size and density as a boundary. Furthermore, classification is not intended to accurately divide the defibrated material into the fiber and the ink particles. The relatively short fiber in the fibers is discharged from the upper air outlet 40*c* together with the ink particles. The relatively large fiber in the ink particles is discharged from the lower outlet 40*b* together with the fiber.

The screening unit 50 screens the classified material (defibrated material) containing the fibers that is classified by the classifying unit 40 by passing through a sieve unit 51 having a plurality of openings. Specifically, the classified material containing the fibers that is classified by the classifying unit 40 is sorted into a passed material that passes through the opening of the sieve unit 51 and a remaining material that does not pass through the opening of the sieve unit 51. The screening unit 50 of the embodiment includes a mechanism of dispersing the classified material in the air by a rotating motion. Then, the material passing through the opening by screening of the screening unit 50 is transported from a passed material transport unit 350 on the accumulation unit 70 side through a pipe 204. On the other hand, the remaining material that does not pass through the opening by screening of the screening unit 50 is returned again to the defibrating unit 30 through a pipe 205 as the material to be defibrated. Thus, the remaining material is re-used (recycled) without being discarded.

The material passing through the opening by screening of the screening unit 50 is transported to the accumulation unit 70 through the pipe 204 in the atmosphere. The passed material is transported from the screening unit 50 to the accumulation unit 70 by airflow generated by the blower 190. Moreover, the blower 190 is omitted and the passed material may be transported from the screening unit 50 that is present in the upper portion to the accumulation unit 70 that is present the lower portion by gravity. The additive feeding unit 60 for adding additives such as binding resin (for example, thermoplastic resin or thermosetting resin) and the like to the transported passed material is provided in the pipe 204 between the screening unit 50 and the accumulation unit 70. Moreover, as the additives, for example, flame retardant, whiteness enhancer, a sheet strength enhancing agent, a sizing agent, an absorption modifier, fragrance, deodorant, and the like may also be fed in addition to the binding resin. The additives are stored in an additive reservoir 61 and are fed from a feeding port 62 by a feeding mechanism (not illustrated).

The blower 190 is disposed between the additive feeding unit 60 and the accumulation unit 70. Both ends of the blower 190 are connected to the pipes 204 and the blower 190 is provided to generate the airflow from the additive feeding unit 60 side to the accumulation unit 70 side. Furthermore, the blower 190 includes a rotation unit (for example, fan blades) and the fiber and additives introduced into the blower 190 are mixed by rotating the rotation unit. Then, a mixture (material containing the fiber) in which the fiber and the additives are mixed is discharged on the accumulation unit 70 side by the airflow.

The accumulation unit 70 is provided to accumulate at least a part of the defibrated material that is defibrated by the defibrating unit 30 in the atmosphere. Specifically, the accumulation unit 70 has a function of uniformly dispersing the fiber in the atmosphere and a function of accumulating the dispersed fiber on a mesh belt 73. The accumulation unit 70 accumulates the material (mixture) containing the fiber and the binding resin fed from the pipe 204 on the mesh belt 73 and forms a web W. Moreover, the web W according to the embodiment refers to a configuration form of an object containing the fiber and the binding resin. Thus, the web W is illustrated as a web W even if the form such as dimensions is changed when heating, pressing, cutting, transporting the web, and the like.

As a mechanism of uniformly dispersing the fiber in the atmosphere, a drum unit 300 into which the fiber and the binding resin are fed is disposed in the accumulation unit 70. Then, it is possible to uniformly mix the binding resin (additive) in the passed material (fiber) by driving the drum unit 300 to rotate. A screen (opening section) having a plurality of small holes (openings) is provided in the drum unit 300. Then, it is possible to uniformly mix the binding resin (additives) in the passed material (fiber) by driving the drum unit 300 to rotate. Then, binding resin (additive) in the passed material (fiber) is uniformly mixed and it is possible to uniformly disperse the fibers or the mixture of the fibers and binding resin passing through the small holes in the atmosphere by driving the drum unit 300 to rotate.

An endless mesh belt 73 in which a mesh is formed is disposed below the drum unit 300. The mesh belt 73 is stretched by stretching rollers 72 and the mesh belt 73 is moved in one direction by rotating at least one of the stretching rollers 72.

Furthermore, a suction device 75 as a suction unit for suctioning the air within a housing unit 400 surrounding the drum unit 300 through the mesh belt 73 is provided vertically below the drum unit 300. The airflow is generated by the suction device 75 from an upper side to a lower side (from the drum unit 300 to the mesh belt 73) and it is possible to suck the fiber (mixture) dispersed in the atmosphere on the mesh belt 73.

Then, the fiber and the like passing through the small hole screen of the drum unit 300 are accumulated on the mesh belt 73 by assisting of a suction force by the suction device 75. In this case, it is possible to form an accumulated material (web W) of an elongated shape containing the fiber and the binding resin by moving the mesh belt 73 in one direction. The continuous strip-shaped continuous web W is formed by continuously performing dispersion from the drum unit 300 and moving of the mesh belt 73. Moreover, the mesh belt 73 may be made of metal, resin, and nonwoven fabric, and may be any one as long as the fiber can be accumulated and the airflow can be passed through. Moreover, if a hole diameter of the mesh of the mesh belt 73 is too large, the fiber enters between the meshes and becomes uneven when forming the web W (sheet), on the other hand, if the hole diameter of the mesh is too small, a stable airflow by the suction device 75 is difficult to form. Thus, it is preferable that the hole diameter of the mesh is appropriately adjusted (set). The suction device 75 can be configured by disposing a closed box (box) having a window of a desired size opened under the mesh belt 73, suctioning air from the outside of the window, and making the inside of the box be a negative pressure.

The web W formed on the mesh belt 73 is transported in a transport direction (white arrows in the view) by rotation of the mesh belt 73. An intermediate transport unit 90 is disposed on an upper side of the mesh belt 73 as a release unit. The web W is released from the mesh belt 73 by the intermediate transport unit 90 and is transported on the forming unit 100 side. The intermediate transport unit 90 is configured so as to transport the web W while suctioning the web W vertically upward (direction separating the web W from the mesh belt 73). The intermediate transport unit 90 is disposed by being separated from the mesh belt 73 vertically upward (direction perpendicular to a surface of the web W) and a part of the intermediate transport unit 90 is disposed to be shifted to the mesh belt 73 on a downstream side in the transport direction of the web W. Then, a transporting section of the intermediate transport unit 90 is a section from a stretching roller 72*a* on the downstream side of the mesh belt 73 to a pressing unit 110 that is a part of the forming unit 100.

The intermediate transport unit 90 has a transport belt 91, a plurality of stretching rollers 92, and a suction chamber 93. The transport belt 91 is an endless mesh belt in which the mesh is formed and which is stretched by the stretching rollers 92. Then, the transport belt 91 is rotated (moves) in one direction by rotating at least one of the plurality of stretching rollers 92.

The suction chamber 93 is disposed on an inside of the transport belt 91 and has a hollow box shape having an upper surface and four side surfaces coming into contact with the upper surface, and of which a bottom surface (surface facing the transport belt 91 positioned below) is opened. Furthermore, the suction chamber 93 includes a suction unit generating the airflow (suction force) into the suction chamber 93. Then, an inner space of the suction chamber 93 is suctioned and air flows from the bottom surface of the suction chamber 93 by driving the suction unit. Thus, the airflow is generated upward on the inside of the suction chamber 93, the web W is suctioned from above, and the web W can be suctioned to the transport belt 91. Then, the transport belt 91 is moved (circulated) by rotating the stretching rollers 92 and can transport the web W to the pressing unit 110. Furthermore, the suction chamber 93 overlaps a part of the mesh belt 73 when viewed from above and is disposed in a position on the downstream side where the suction device 75 does not overlap. Thus, the web W on the mesh belt 73 is released from the mesh belt 73 in a position facing the suction chamber 93 and can be suctioned to the transport belt 91. The stretching rollers 92 rotate such that the transport belt 91 moves at the same speed as that of the mesh belt 73. If there is a difference in the speeds of the mesh belt 73 and the transport belt 91, it is possible to prevent that the web W is broken or buckled by being pulled by making the speed thereof be the same speed.

The forming unit 100 is provided to form a sheet Pr by using the accumulated material. The forming unit 100 of the embodiment includes the pressing unit 110, a heating unit 120, a cutting unit 130, and the like. The pressing unit 110 is provided to press the web W as the accumulated material that is accumulated by the accumulation unit 70. The pressing unit 110 is configured of a pair of pressing rollers 111 and 112, and initially presses the web W. That is, the sheet manufacturing apparatus 1 has a configuration which does not have another pressing unit (for example, another pair of pressing rollers) for pressing the web W formed between the accumulation unit 70 and the pressing unit 110 by the accumulation unit 70. Moreover, the pressing unit 110 of the embodiment presses the web W so as to be approximately 1/5 to 1/30 of the thickness of the web W formed by the accumulation unit 70. Thus, a configuration, in which a single roller, the transfer belt, and the like are disposed between the accumulation unit 70 and the pressing unit 110 for simply transporting the web W, may be provided. Furthermore, a configuration, in which rollers (pair of rollers) finely pressing (pressure of an extent not beyond a pressure to be the above described thickness of the web W) the web W is disposed, may be provided. Then, the pressing unit 110 presses the web W transported by the intermediate transport unit 90 by interposing the web W between the pair of pressing rollers 111 and 112. Thus, it is possible to enhance the strength of the web W by pressing the web W. Moreover, a detailed configuration of the pressing unit 110 will be described below.

The heating unit 120 is disposed on a downstream side of the pressing unit 110 in the transport direction. The heating unit 120 is provided to bind the fibers containing the web W through the binding resin. The heating unit 120 of the embodiment is configured of a pair of heating rollers 121 and 122. A heating member (heating source) such as a heater is provided in a center portion of rotary shafts of the heating rollers 121 and 122, and it is possible to heat and press the web W by transporting the web W by pinching the web W by the pair of heating rollers 121 and 122. The web W is heated and pressed and thereby the binding resin is easily entangled with the fiber by being melted, fiber intervals between the fibers are shortened, and contact points between the fibers are increased. Thus, the strength is enhanced as the web W having high density.

As the cutting unit 130 cutting the web W, a first cutting unit 130*a* cutting the web W in a direction intersecting the transport direction of the web W and a second cutting unit 130*b* cutting the web W along the transport direction of the web W are disposed on the downstream side of the heating unit 120 in the transport direction. The first cutting unit 130*a* includes a cutter and cuts the continuous web W in a sheet form according to a cutting position that is set in a predetermined length. The second cutting unit 130*b* has a cutter and cuts the web W according to a predetermined cutting position in the transport direction of the web W. Thus, the sheet Pr (web W) of a desired size is formed. The cut sheets Pr are stacked on a stacker 160 and the like. Moreover, it may be configured so as to wind the continuous web W by a winding roller in a roll shape by a winding roller without cutting the web W. As described above, it is possible to manufacture the sheet Pr in the sheet manufacturing apparatus 1.

Moreover, the sheet according to the embodiment mainly refers to that formed in a sheet shape, which contains the fiber such as the used paper and the pure pulp as the raw material. However, the sheet is not limited to the embodiment and may be a board shape or a web shape (or a shape having unevenness). Furthermore, as the raw material, plant fibers such as cellulose, chemical fibers such as polyethylene terephthalate (PET) and polyester, and animal fibers such as wool and silk may be included. The sheet in the present application is divided into paper and non-woven fabric. Paper includes aspects formed in a thin sheet shape and includes recording paper for writing or printing, wallpaper, wrapping paper, colored paper, Kent paper, and the like. Non-woven fabric has a thickness thicker than that of paper or has a strength lower than that of paper, and includes non-woven fabric, fiber board, tissue paper, kitchen paper, cleaner, filter, liquid absorption material, sound-absorbing material, cushioning material, mat, and the like.

Furthermore, the used paper in the embodiment described above mainly refers to printed paper and it is regarded as the used paper regardless of whether or not the paper is used as long as paper is formed as the raw material.

Figure 2A:
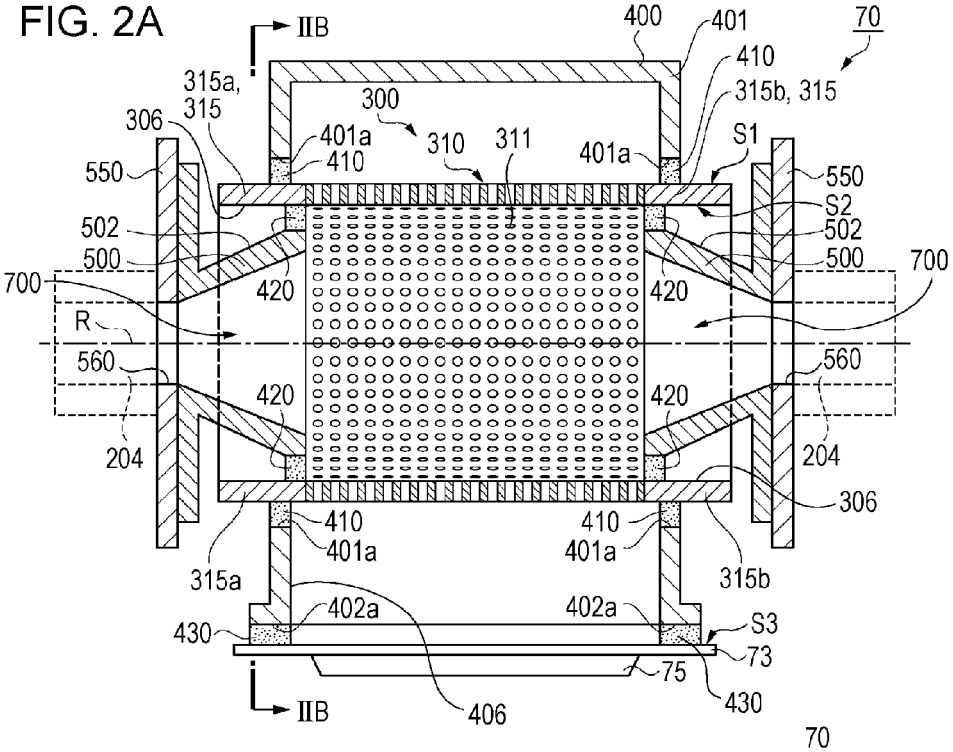
FIG. 2A is a schematic view illustrating a configuration of an accumulation unit according to the first embodiment and a sectional view in a rotational axis direction.
Figure 2B:
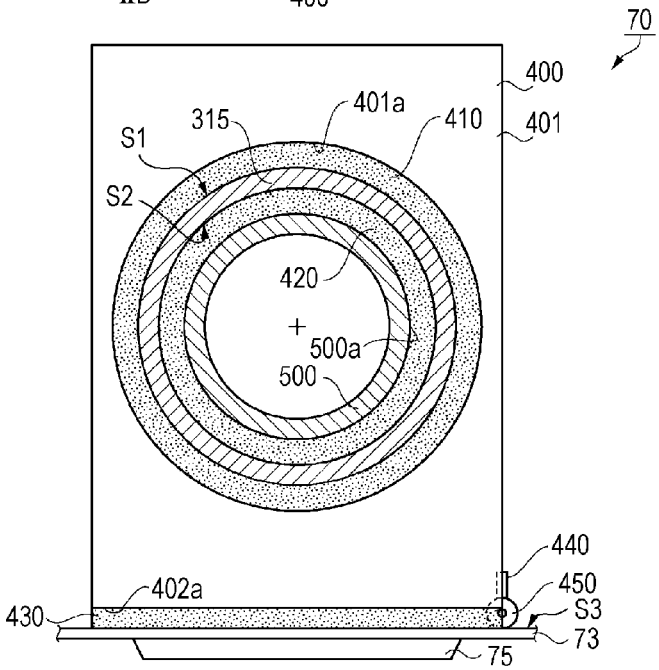
FIG. 2B is a schematic view illustrating a configuration of the accumulation unit according to the first embodiment and a sectional view that is taken along line IIB-IIB in FIG. 2A.

Next, a detailed configuration of the accumulation unit 70 will be described. FIGS. 2A and 2B are schematic views illustrating the configuration of the accumulation unit, FIG. 2A is a sectional view in a rotation axis direction, and FIG. 2B is a sectional view that is taken along line IIB-IIB in FIG. 2A. Furthermore, FIG. 3 is a perspective view illustrating a configuration of the drum unit.

As illustrated in FIGS. 2A and 2B, the accumulation unit 70 includes the drum unit 300, a material supply unit 500, the housing unit 400, and the like. Furthermore, the accumulation unit 70 includes a diffusion section 700, which diffuses the airflow from an upstream side to a downstream side in a supply direction of the airflow flowing through the drum unit, in at least one of the drum unit 300 and the material supply unit 500. Here, "diffusing" means to have a component in a direction (direction toward a peripheral surface) perpendicular to an extending direction of a rotation axis R of the drum unit 300 that is an airflow direction of a material supply port 560 in FIG. 2A. Hereinafter, specific description will be given.

Figure 3:
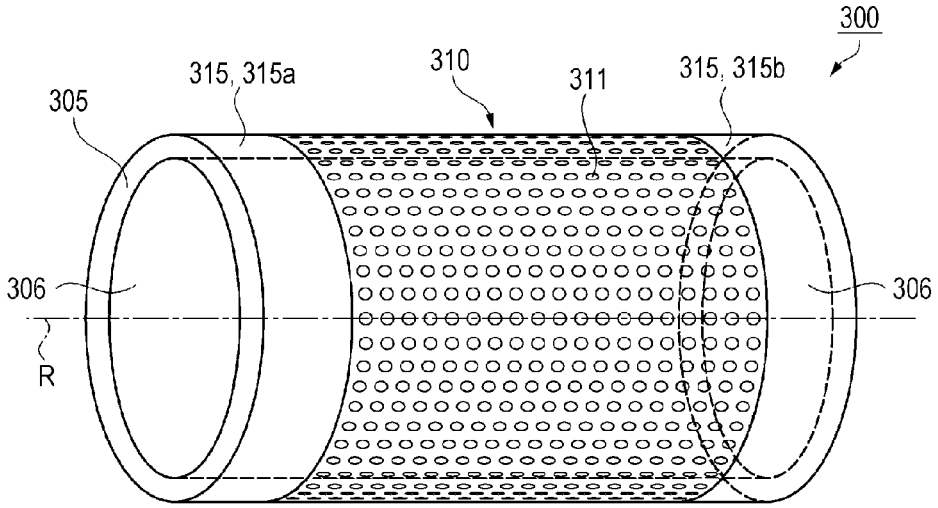
FIG. 3 is a perspective view illustrating a configuration of a drum according to the first embodiment.

The drum unit 300 has a rotatable cylindrical section 305 and as illustrated in FIG. 3, the cylindrical section 305 has an opening section 310 having a plurality of openings 311 and a tubular unit 315 having no opening 311. The opening section 310 and the tubular unit 315 are coupled, for example, by welding or screws, and are integrally rotated. The cylindrical section 305 is formed in a cylindrical shape by using a metal plate such as stainless steel having a uniform thickness and opening ports 306 are provided on both ends thereof.

The opening section 310 is configured of a punched metal in which the plurality of openings 311 are provided. The opening section 310 is configured such that the material containing the fibers passes through the openings 311 and is dispersed. A size, a forming region of the openings 311, and the like are appropriately set by a size and a type of the material, and the like. Moreover, the opening section 310 is not limited to the punched metal and may be a wire mesh material and the like. The plurality of openings 311 are disposed in the same size (area) respectively at equal intervals. Thus, the material passing through the openings 311 is accumulated on the mesh belt 73 with uniform thickness and density. Furthermore, when passing through the openings 311, the entangled fibers are loosened. The tubular unit 315 is a portion which does not have the opening 311 and the like and is a portion coming into contact with the housing unit 400.

The housing unit 400 surrounds a periphery of the drum unit 300 and as illustrated in FIGS. 2A and 2B, has a frame 401 of which five wall surfaces are bonded, and has a space unit on an inside thereof. A lower portion of the housing unit 400 is not a wall surface and an opening 406 is provided. Furthermore, the housing unit 400 has frame bonding surfaces 401*a* that are circular openings on two wall surfaces facing in the rotation axis direction R of the drum unit 300 and first pile seal units 410 described below are bonded to the frame bonding surfaces 401*a*. The housing unit 400 does not have openings other than the opening 406 and the frame bonding surface 401*a*. The housing unit 400 surrounds the drum unit 300 such that the opening section 310 of the drum unit 300 is disposed on an inside thereof. That is, the opening section 310 of the drum unit 300 is positioned within a space on the inside of the housing unit 400. Then, the housing unit 400 and the tubular unit 315 come into contact with each other through the first pile seal units 410. In the embodiment, as illustrated in FIG. 3, the drum unit 300 has a tubular unit 315*a*, the opening section 310, and a tubular unit 315*b* in the extending direction of a rotation axis R, and as illustrated in FIGS. 2A and 2B, the housing unit 400 comes into contact with a surface S1 of the cylindrical section in the tubular units 315*a* and 315*b*. As described above, the housing unit 400 comes into contact with the tubular units 315*a* and 315*b* and thereby it is possible to suppress discharge of the material containing the fibers and the like passing through the openings 311 from the inside of the housing unit 400 to the outside of the housing unit 400. Furthermore, the housing unit 400 is disposed on the inside of the drum unit 300 in the rotation axis direction R of the drum unit 300. Thus, a width dimension of the housing unit 400 may be shorter than a width dimension of the drum unit 300 in the rotation axis direction R and it is possible to reduce a size of the apparatus. Moreover, a dimension of the housing unit 400 is greater than an outer diameter dimension of the drum unit 300 in a direction orthogonal to the rotation axis direction R of the drum unit 300 and thereby the drum unit 300 is disposed on an inside of the housing unit 400.

Furthermore, the housing unit 400 of the embodiment has the first pile seal unit 410 and the surface S1 of the tubular unit 315 comes into contact with the first pile seal unit 410 (sliding contact). The first pile seal unit 410 is configured of, for example, a base unit and a plurality of fibers that are densely planted on one surface side of the base unit. The first pile seal unit 410 has the plurality of fibers (pile yarns) which are densely planted to the extent that the fibers passing through the openings 311 of the drum unit 300 cannot pass through the plurality of fibers. Then, it is configured such that the other surface of the base unit of the first pile seal unit 410 is bonded to the frame bonding surface 401*a* of the housing unit 400 and tip end portions of the fibers of the first pile seal unit 410 come into contact with the surface S1 of the tubular unit 315. The openings 311 are not formed on the surface S1 of the tubular unit 315 coming into contact with the first pile seal unit 410. Furthermore, it is preferable that unevenness is not present at least on the surface S1 coming into contact with the first pile seal unit 410. Thus, a gap between the frame 401 of the housing unit 400 and the tubular unit 315 of the drum unit 300 is substantially closed by the first pile seal unit 410. Thus, the material containing the fibers and the like passing through the openings 311 of the drum unit 300 are held on the inside of the housing unit 400 and it is possible to suppress discharge of the material to the outside of the housing unit 400. Furthermore, it is possible to suppress entry of foreign materials from the outside of the housing unit 400. Furthermore, when the drum unit 300 is rotated about the rotation axis direction R, wear in a sliding portion between the tubular unit 315 and the first pile seal unit 410 is suppressed and it is possible to reduce a rotational load of the drum unit 300. Moreover, the length of the fiber of the first pile seal unit 410 is set to be longer than the gap between the frame 401 of the housing unit 400 and the tubular unit 315 of the drum unit 300. It is because the first pile seal unit 410 reliably comes into contact with the tubular unit 315. Moreover, the first pile seal unit 410 may be provided in the tubular unit 315. However, in this case, the drum unit 300 is shifted to the housing unit 400 in an extending direction of the rotation axis direction R, and there is a concern that a contact area between the first pile seal unit 410 and the frame 401 is reduced. Thus, it is preferable that the first pile seal unit 410 is provided in the housing unit 400 and comes into contact with the tubular unit 315 with a size greater than (width is wider) the first pile seal unit 410 in the extending direction of the rotation axis direction R.

Furthermore, in the embodiment, as illustrated in FIGS. 2A and 2B, the fixed material supply units 500 are provided on the inside of the tubular unit 315 of the drum unit 300. In the embodiment, the pipes 204 are divided into two parts and are respectively connected to the material supply units 500 corresponding to the tubular unit 315 of both ends of the drum unit 300. The material supply units 500 are provided to supply the material containing the fibers passing through the pipe 204 to the drum unit 300. The material supply unit 500 of the embodiment configures the diffusion section 700 of which a cross-sectional area on the downstream side is greater than a cross-sectional area on the upstream side in the flowing direction of the airflow. That is, a taper is provided in a supply path for supplying the material containing the fibers from the pipe 204 to the inside of the drum unit 300. The supply path is gradually widened from the pipe 204 side to the drum unit 300 (opening section 310) side. Furthermore, as illustrated in FIG. 2A, an end portion of the material supply unit 500 on the downstream side is applied to the opening section 310 in sectional view. Moreover, a length and a taper amount of the material supply unit 500 from an end portion on the upstream side to the end portion on the downstream side are appropriately set in compliance with the intensity of the airflow and the like.

The material supply unit 500 comes into contact with the tubular unit 315 through a second pile seal unit 420. That is, the material supply unit 500 and the tubular unit 315 are configured to be slidable through the second pile seal unit 420. In the embodiment, the material supply unit 500 is disposed on insides of both tubular units 315*a* and 315*b* of the drum unit 300. The end portion of the material supply unit 500 on the upstream side is fixed to a flange fixing plate 550. Then, the flange fixing plate 550 is fixed to an external frame (not illustrated). The material supply port 560 for supplying the material containing the fibers to the inside of the drum unit 300 is provided in the flange fixing plate 550.

The second pile seal unit 420 is provided between a rear surface S2 of the tubular unit 315 and a surface 502 of the material supply unit 500. The second pile seal unit 420 is configured of, for example, a base unit and a plurality of fibers that are densely planted on one surface side of the base unit. The second pile seal unit 420 has the plurality of fibers which are densely planted to an extent that the material containing the fibers cannot pass through the plurality of fibers. Then, in the embodiment, it is configured such that the other surface of the base unit of the second pile seal unit 420 is bonded to the surface 502 of the material supply unit 500 and tip end portions of the fibers of the second pile seal unit 420 come into contact with the rear surface S2 of the tubular unit 315. Thus, a gap between the material supply unit 500 and the tubular unit 315 of the drum unit 300 is substantially closed by the second pile seal unit 420. Thus, it is possible to suppress discharge of the material containing the fibers to the outside from the gap between the tubular unit 315 and the material supply unit 500. Furthermore, it is possible to suppress entry of foreign materials from the outside of the material supply unit 500. Furthermore, since the drum unit 300 is rotated about the rotation axis R, wear in a sliding portion, where the tubular unit 315 and the second pile seal unit 420 are rubbed, is suppressed and it is possible to reduce the rotational load of the drum unit 300. Moreover, the length of the fiber of the second pile seal unit 420 is, for example, set to be longer than the gap between the material supply unit 500 and the tubular unit 315 of the drum unit 300. It is because the second pile seal unit 420 reliably comes into contact with the tubular unit 315. Since the second pile seal unit 420 is bonded to the material supply unit 500, the material supply unit 500 can be said to have the second pile seal unit 420. Moreover, the second pile seal unit 420 may be bonded to the tubular unit 315.

Furthermore, the second pile seal unit 420 is bonded to the lowermost downstream side (opening section 310 side) in the material supply unit 500. The second pile seal unit 420 is not limited to the configuration and may be provided in a position on a further upstream side (material supply port 560 side) than a position illustrated in FIG. 2A. In this case, a gap is generated between the material supply unit 500 and the tubular unit 315, the material containing the fibers enters the gap, and then a sliding load of the drum unit 300 may be increased. Thus, if the second pile seal unit 420 is bonded to the end portion of the material supply unit 500 on the downstream side (opening section 310 side), it is preferable in that the increase in the sliding load can be prevented. Moreover, the drum unit 300 is supported by a support unit (not illustrated) and weight of the drum unit 300 is not applied to the first pile seal unit 410 or the second pile seal unit 420.

Furthermore, in the embodiment, as illustrated in FIG. 2B, the housing unit 400 has a roller 450 coming into contact with the web W on the downstream side in the transport direction of the web W. Furthermore, the housing unit 400 has a third pile seal unit 430 coming into contact with the mesh belt 73 on the further upstream side in the transport direction of the web W than a position where the roller 450 is disposed.

The third pile seal unit 430 is configured of, for example, a base unit and a plurality of fibers that are densely planted on one surface side of the base unit. The third pile seal unit 430 has the plurality of fibers (pile yarns) which are densely planted to the extent that the material containing the fibers passing through the drum unit 300 cannot pass through the plurality of fibers. Then, the third pile seal units 430 are disposed in a position other than the position in which the roller 450 of the housing unit 400 is disposed. That is, the third pile seal units 430 are disposed in three positions of the frame 401 of the housing unit 400. It is configured such that the other surface of the base unit of the third pile seal unit 430 is bonded to a frame bonding surface 402*a* of the housing unit 400 and tip end portions of the fibers of the third pile seal unit 430 come into contact with a surface S3 of the mesh belt 73. A dimension (width) of the mesh belt 73 is greater than that of and the housing unit 400 in a direction orthogonal to a moving direction (the transport direction of the web W) of the mesh belt 73. Thus, the gap between three sides of the housing unit 400 and the mesh belt 73 is configured to be substantially closed by the third pile seal unit 430. When the mesh belt 73 is moved (rotated), wear of the mesh belt 73 and the third pile seal unit 430 is suppressed and it is possible to reduce the load to the mesh belt 73. A length of the third pile seal unit 430 is set, for example, to be longer than the gap between the frame bonding surface 402*a* of the frame 401 of the housing unit 400 and the mesh belt 73. The third pile seal unit 430 reliably comes into contact with the mesh belt 73.

As illustrated in FIG. 2B, the roller 450 of the housing unit 400 has a rotation axis along a direction (width direction of the web W) intersecting the transport direction of the web W. Furthermore, the roller 450 has a length equal to the width dimension (width direction of the web W) of the frame 401 in the width direction of the web W.

Furthermore, the roller 450 is connected to a driving unit (not illustrated) such as a motor driving the roller 450. The web W is easily pulled in the transport direction and it is possible to reliably transport the web W by driving the roller 450 to be rotated (counterclockwise direction in FIG. 2B). Furthermore, the roller 450 is capable of moving in an up and down direction (direction intersecting an accumulation surface of the mesh belt 73 or the thickness direction of the web W) and is biased downward (mesh belt 73 side) by a biasing member (not illustrated). Thus, a position according to the thickness of the web W accumulated on the mesh belt 73 is variable by the drum unit 300 and it is possible to transport the web W without destroying it even if the web W having a different thickness is transported.

Furthermore, on the downstream side in the transport direction of the web W, the housing unit 400 has a fourth pile seal unit 440 and the fourth pile seal unit 440 comes into contact with the roller 450. Since a configuration of the fourth pile seal unit 440 is the same as that of the third pile seal unit 430, the description will be omitted. Then, it is configured such that the other surface of the base unit of the fourth pile seal unit 440 is bonded to the frame of the housing unit 400 and tip end portions of the fibers of the fourth pile seal unit 440 come into contact with a surface (peripheral surface) of the roller 450. Thus, a gap between the frame bonding surface 402*a* of the housing unit 400 and the roller 450 is substantially closed by the fourth pile seal unit 440. Furthermore, generation of wear in a sliding portion, where the roller 450 that is driven to rotate and the fourth pile seal unit 440 are rubbed, is suppressed and it is possible to reduce a load to the roller 450. The length of the fiber of the fourth pile seal unit 440 is set such that the fourth pile seal unit 440 reliably comes into contact with the roller 450. For example, the length of the fiber of the fourth pile seal unit 440 is set to be longer than the gap between the frame of the frame 401 of the housing unit 400 and the surface of the roller 450.

Above, as illustrated in FIGS. 2A and 2B, the gap between the housing unit 400 and the mesh belt 73 is substantially closed by the third pile seal unit 430 in the three positions of four positions of the frame 401 of the housing unit 400 corresponding to the surface S3 of the mesh belt 73. Furthermore, the gap between the housing unit 400 and the mesh belt 73 is substantially closed by the fourth pile seal unit 440 and the roller 450 in a remaining one position. Thus, the material containing the fibers and the like passing (before accumulated) through the openings 311 of the drum unit 300 are held on the inside of the housing unit 400, and it is possible to suppress discharge to the outside of the housing unit 400.

Furthermore, in the embodiment, it is configured such that outside air (air) is suctioned from the sliding contact part between the drum unit 300 and the housing unit 400 when suctioning the material containing the fibers by the suction device 75. Specifically, it is configured such that outside air is suctioned toward the drum unit 300 and the housing unit 400 through the first pile seal unit 410 that is the sliding contact part between the drum unit 300 and the housing unit 400, and the second pile seal unit 420 that is the sliding contact part between the drum unit 300 and the material supply unit 500. In this case, it is configured such that an air flow of air suctioned by the suction device 75 is larger than an air flow flowing from the material supply units 500 disposed in both ends of the drum unit 300 into the drum unit 300. Thus, air is suctioned from the outside into the housing unit 400 through the first pile seal unit 410 and the second pile seal unit 420. Moreover, if air is suctioned from the outside into the housing unit 400 through the third pile seal unit 430 and the fourth pile seal unit 440, turbulence occurs in the vicinity of the mesh belt 73 and the fibers passing through the openings 311 of the drum unit 300 are unlikely to be accumulated on the mesh belt 73. Thus, in the embodiment, densities of the third pile seal unit 430 and the fourth pile seal unit 440 are higher (densely) than densities of the first pile seal unit 410 and the second pile seal unit 420. In this case, for example, densities of the fibers configuring the third pile seal unit 430 and the fourth pile seal unit 440 are higher than densities of the fibers configuring the first pile seal unit 410 and the second pile seal unit 420. Furthermore, the width dimensions and height dimensions of the third pile seal unit 430 and the fourth pile seal unit 440 are greater than the width dimensions and height dimensions of the first pile seal unit 410 and the second pile seal unit 420. Thus, it is possible to reduce suction of outside air from the third pile seal unit 430 and the fourth pile seal unit 440.

Next, a method for operating the accumulation unit 70 will be described. First, the fibers classified by the classifying unit 40 and the material containing the fibers fed from the additive feeding unit 60 are supplied from the material supply unit 500 to the drum unit 300 side through the pipe 204. The end portion of the material supply unit 500 on the drum unit 300 side is adjacent to the opening section 310 and the material supplied from the material supply unit 500 flows toward the opening section 310.

Then, the drum unit 300 is driven by a driving unit (motor and the like) (not illustrated) to be rotated about the rotation axis R. Thus, the fibers and resin supplied on the inside of the drum unit 300 are mixed and the material containing the fibers and resin are dispersed by a centrifugal force. Then, the dispersed material passes through the openings 311 of the opening section 310. The material passing through the openings 311 falls and is accumulated on the mesh belt 73.

Here, as described above, the material supply unit 500 includes the diffusion section 700 of which the cross-sectional area is gradually increased from the upstream side to the downstream side. Thus, the airflow flowing from the pipe 204 to the material supply unit 500 flows while diffusing in the material supply unit 500 (diffusion section 700). Then, the diffused airflow flows from the material supply unit 500 into the drum unit 300. Thus, the material supplied from the material supply unit 500 to the drum unit 300 (opening section 310) is efficiently dispersed within the drum unit 300 (opening section 310) by the diffused airflow.

Furthermore, since it is configured such that the air flow of air suctioned by the suction device 75 is larger than the air flow flowing from the material supply units 500 disposed in both ends of the drum unit 300 into the drum unit 300, outside air (air) is suctioned from the outside to the inside of the housing unit 400 through the first pile seal unit 410 and the second pile seal unit 420. A speed of the airflow in the vicinity of the first pile seal unit 410 and the second pile seal unit 420 in the drum unit 300 is increased by the suctioned outside air. Thus, it is possible to suppress catching or aggregation of the fibers within the drum unit 300 or the housing unit 400.

According to the first embodiment described above, it is possible to obtain the following effects.

The diffusion section 700 of which the cross-sectional area is gradually increased toward the downstream side is provided in the material supply unit 500 and thereby the material containing the fibers is dispersed within the drum unit 300 when supplying the material to the drum unit 300 by the airflow. Thus, fiber lumps, aggregation of the fibers, and the like are reduced within the drum unit 300 and it is possible to reduce the amount of the material containing the fibers that does not pass through the openings 311 of the drum unit 300.

Furthermore, air is suctioned from the outside to the inside of the housing unit 400 through the first pile seal unit 410 and the second pile seal unit 420, and the speed of the airflow in the vicinity of the first pile seal unit 410 and the second pile seal unit 420 is increased. Thus, it is possible to suppress catching or aggregation of the fibers within the drum unit 300 or the housing unit 400 and thus texture of the sheet is improved.

Second Embodiment

Next, a second embodiment will be described. Since a basic configuration of a sheet manufacturing apparatus is the same as that of the first embodiment, description thereof will be omitted. Hereinafter, a configuration different from the first embodiment, that is, a configuration of an accumulation unit is mainly described.

Figure 4:
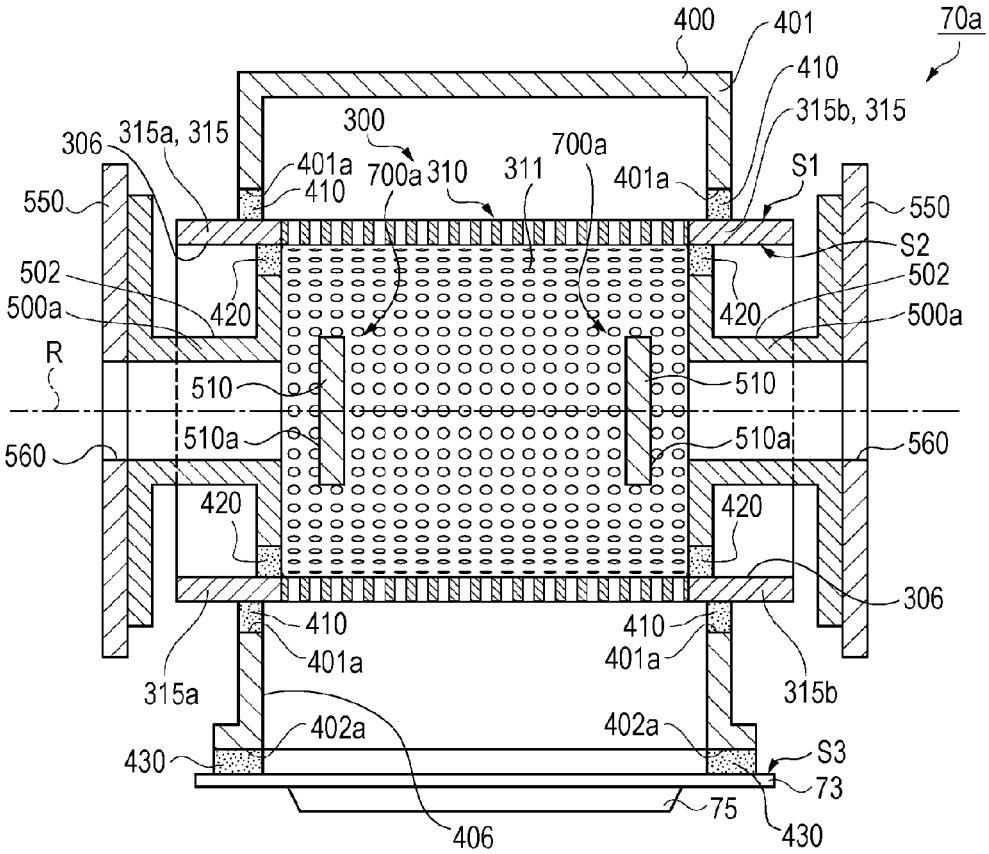
FIG. 4 is a schematic view illustrating a configuration of an accumulation unit according to a second embodiment.

FIG. 4 is a schematic view illustrating the configuration of the accumulation unit according to the embodiment. As illustrated in FIG. 4, an accumulation unit **70*a* includes a drum unit 300, a material supply unit 500*a*, a housing unit 400**, and the like. Same reference numerals are given to members having the same functions as the configuration members of the first embodiment and detailed description will be omitted.

In the embodiment, the fixed material supply unit **500*a* is provided on insides of tubular units 315*a* and 315*b* of the drum unit 300. Similar to the first embodiment, pipes 204 divided into two parts are respectively connected to the material supply units 500*a*. The material supply units 500*a* are provided to supply the material containing the fibers passing through the pipes 204 to the drum unit 300. An inner diameter (flow diameter) of the material supply unit 500*a* is uniform. That is, a cross-sectional area from the upstream side to the downstream side is equal to each other in the material supply unit 500*a*. An end portion of the material supply unit 500*a* on the downstream side is adjacent to an opening section 310 in sectional view. A length, a flow path diameter from an end portion on the upstream side to an end portion on the downstream side of the material supply unit 500***a*, and the like are appropriately set in compliance with intensity of the airflow and the like.

The accumulation unit 70*a* includes a diffusion section 700*a* in at least one of the drum unit 300 and the material supply unit 500*a*. The diffusion section 700*a* is provided such that the airflow is diffused on the downstream side more than the upstream side in a supply direction (flowing direction) of the airflow. The diffusion section 700*a* of the embodiment is a changing section 510 that changes a direction of the airflow within the drum unit 300.

As illustrated in FIG. 4, the changing sections 510 are positioned in a region in which the opening section 310 is disposed in sectional view, are positioned in positions separated from the material supply units 500*a*, and are disposed such that at least a part of the changing section 510 faces the material supply port 560. The changing section 510 is supplied on the material supply unit 500*a* by a support unit (not illustrated). The changing section 510 of the embodiment is a plate member and is disposed such that a facing surface 510*a* facing the material supply port 560 is substantially perpendicular to a rotation axis R of the drum unit 300. That is, the facing surface 510*a* is formed in a direction that is substantially perpendicular to the flowing direction of the airflow in the material supply unit 500*a*.

Furthermore, the housing unit 400 has a roller 450 coming into contact with a web W and a fourth pile seal unit 440 in the downstream side in the transport direction of the web W (see FIG. 2B). Furthermore, similar to the first embodiment, it is configured such that outside air is suctioned from a sliding contact part (first pile seal unit 410 and a second pile seal unit 420) between the drum unit 300 and the housing unit 400 when suctioning the material containing the fibers by the suction device 75.

The airflow flowing from the material supply port 560 of the material supply unit 500*a* into the drum unit 300 collides with the changing section 510, is diffused, and flows on an upper side and a lower side of the drum unit 300. Thus, the material supplied from the material supply unit 500*a* to the drum unit 300 (opening section 310) is efficiently dispersed within the drum unit 300 (opening section 310) by the diffused airflow.

Furthermore, similar to the first embodiment, the speed of the airflow in the vicinity of the first pile seal unit 410 and the second pile seal unit 420 is increased by outside air suctioned from the first pile seal unit 410 and the second pile seal unit 420. Thus, it is possible to suppress catching and aggregation of the fibers within the drum unit 300 or the housing unit 400.

According to the second embodiment described above, it is possible to obtain the following effects.

The airflow flowing from the material supply unit 500*a* into the drum unit 300 collides with the changing section 510 and the direction of the airflow is changed on the upper side and the lower side of the drum unit 300, and the airflow is diffused. Thus, a dispersing effect of the material is enhanced, fiber lumps, aggregation of the fibers, and the like are reduced within the drum unit 300, and it is possible to reduce the amount of the material containing the fibers that does not pass through the openings 311 of the drum unit 300.

Third Embodiment

Next, a third embodiment will be described. Since a basic configuration of a sheet manufacturing apparatus is the same as that of the first embodiment, description thereof will be omitted. Hereinafter, a configuration different from the first embodiment, that is, a configuration of an accumulation unit is mainly described.

Figure 5:
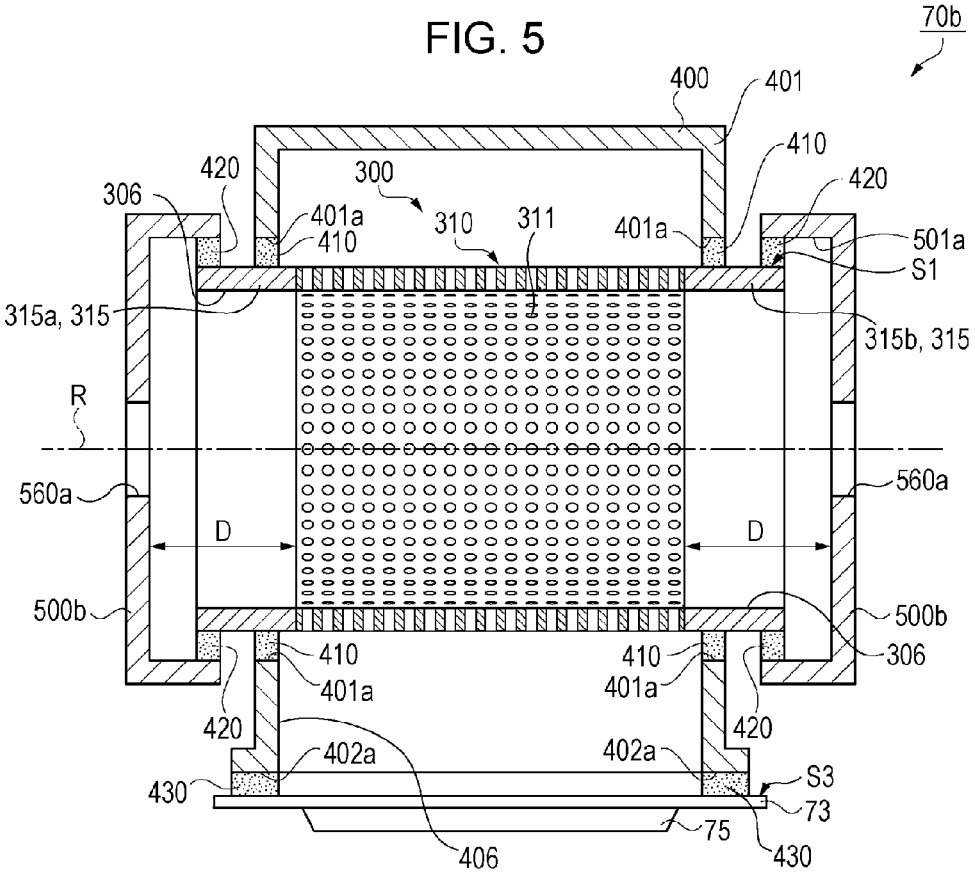
FIG. 5 is a schematic view illustrating a configuration of an accumulation unit according to a third embodiment.

FIG. 5 is a schematic view illustrating the configuration of the accumulation unit according to the embodiment. As illustrated in FIG. 5, an accumulation unit 70*b* includes a drum unit 300, a material supply unit 500*b*, a housing unit 400, and the like. Same reference numerals are given to members having the same functions as the configuration members of the first embodiment and detailed description will be omitted.

In the embodiment, the fixed material supply unit 500*b* is provided on an outside of the tubular unit 315 of the drum unit 300 and the tubular unit 315 comes into contact with the material supply unit 500*b* through a second pile seal unit 420. That is, the material supply unit 500*b* and the second pile seal unit 420 are disposed on the outside of both tubular units 315*a* and 315*b* of the drum unit 300. A material supply port 560*a* for supplying the material containing the fibers to an inside of the drum unit 300 is provided in the material supply unit 500*b*. The material supply ports 560*a* are respectively connected to pipes 204 that are divided into two parts. The material supply unit 500*b* is provided to supply the material containing the fibers passing through the pipe 204 to the drum unit 300.

Then, a second pile seal unit 420 is provided between a surface (outer peripheral surface) S1 of the tubular unit 315 and a rear (back) surface (inner peripheral surface) 501*a* of the material supply unit 500*b*. It is configured such that the other surface of a base unit of the second pile seal unit 420 is bonded to the rear surface 501*a* of the material supply unit 500*b* and tip end portions of the fibers of the second pile seal unit 420 come into contact with the surface S1 of the tubular unit 315. Thus, a gap between the material supply unit 500*b* and the tubular unit 315 of the drum unit 300 is substantially closed by the second pile seal unit 420.

Then, a supply port 560*a* of the material supply unit 500*b* is disposed in a position in which the airflow is diffused within the drum unit 300 with respect to the opening section 310. Specifically, the supply port 560*a* is provided in a position that is separated from an end portion of the opening section 310 by a distance D in the rotation axis direction R. That is, the supply port 560*a* is not disposed in a region of the opening section 310, is not adjacent to the opening section 310, and is disposed being separated from the end portion of the opening section 310 with a gap of the distance D. Moreover, the distance D between the supply port 560*a* and the end portion of the opening section 310 is appropriately set in compliance with intensity of the airflow.

Furthermore, the housing unit 400 has the roller 450 coming into contact with the web W and the fourth pile seal unit 440 on the downstream side in the transport direction of the web W (see FIG. 2B). Furthermore, similar to the first embodiment, it is configured such that outside air is suctioned from a sliding contact part (first pile seal unit 410) between the drum unit 300 and the housing unit 400 when suctioning the material containing the fibers by the suction device 75.

Here, an opening area of the opening port 306 of the drum unit 300 is wider than an opening area of the supply port 560*a* and the distance D is provided from the supply port 560*a* to the opening section 310 in the rotation axis direction R. Thus, the airflow flowing from the supply port 560*a* into the drum unit 300 is diffused and flows from the supply port 560*a* to the opening section 310 of the drum unit 300. Thus, the material supplied from the material supply unit 500*b* to the drum unit 300 is efficiently dispersed within the drum unit 300 by the diffused airflow.

Furthermore, similar to the first embodiment, the speed of the airflow in the vicinity of the first pile seal unit 410 is increased by outside air suctioned from the first pile seal unit 410. Thus, it is possible to suppress catching and aggregation of the fibers within the drum unit 300 or the housing unit 400.

According to the third embodiment described above, it is possible to obtain the following effects.

The supply port 560*a* and the opening section 310 are disposed with the gap by providing the distance D in the rotation axis direction R and thereby the airflow flowing from the supply port 560*a* flows into the opening section 310. Thus, a dispersing effect of the material is enhanced, fiber lumps, aggregation of the fibers that are mass of the fibers, and the like are reduced within the drum unit 300, and it is possible to reduce an amount of the material containing the fibers that does not pass through the drum unit 300.

Fourth Embodiment

Next, a fourth embodiment will be described. Since a basic configuration of the sheet manufacturing apparatus is the same as that of the first embodiment, description thereof will be omitted. Hereinafter, a configuration different from the first embodiment, that is, a configuration of an accumulation unit is mainly described.

Figure 6:
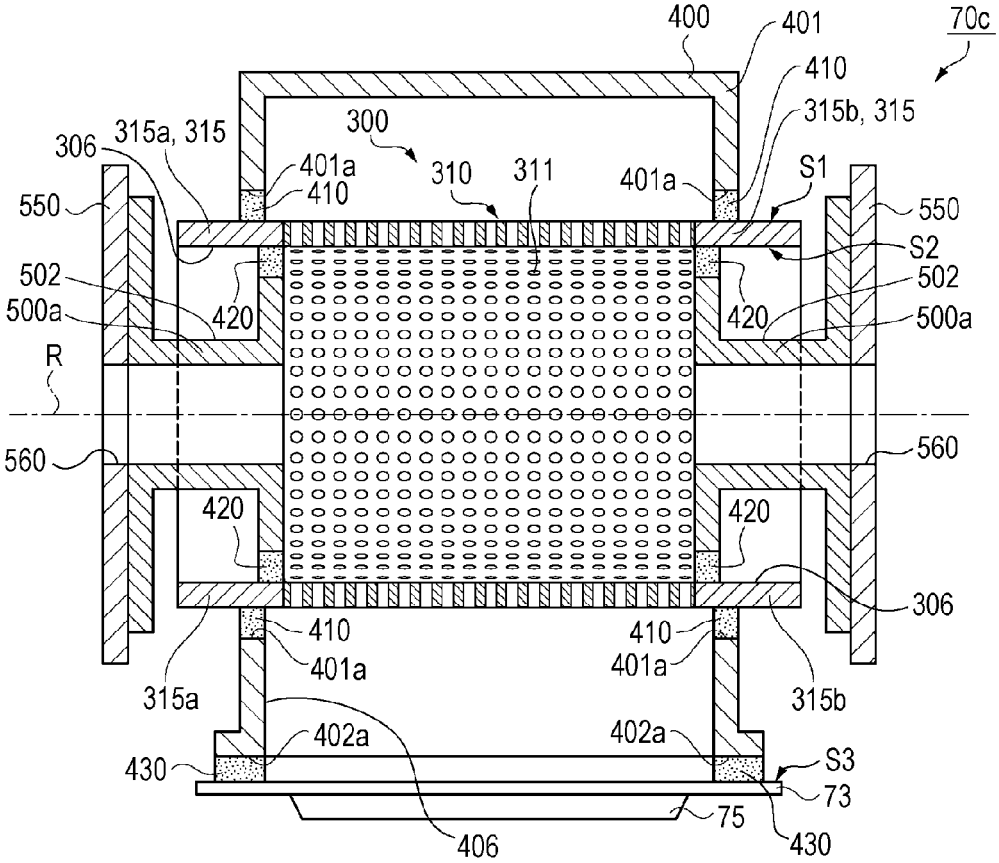
FIG. 6 is a schematic view illustrating a configuration of an accumulation unit according to a fourth embodiment.

FIG. 6 is a schematic view illustrating the configuration of the accumulation unit according to the embodiment. As illustrated in FIG. 6, an accumulation unit 70*c* includes a drum unit 300, a material supply unit 500*a*, a housing unit 400, and the like. Same reference numerals are given to members having the same functions as the configuration members of the above embodiment and detailed description will be omitted.

In the embodiment, the fixed material supply unit 500*a* is provided on insides of tubular units 315*a* and 315*b* of the drum unit 300. Similar to the first embodiment, pipes 204 divided into two parts are respectively connected to the material supply units 500*a*. The material supply units 500*a* are provided to supply the material containing the fibers passing through the pipes 204 to the drum unit 300. An inner diameter (flow diameter) of the material supply unit 500*a* is uniform. That is, a cross-sectional area from the upstream side to the downstream side is equal to each other in the material supply unit 500*a*. An end portion of the material supply unit 500*a* on the downstream side is adjacent to an opening section 310 in sectional view. A length, a flow path diameter from an end portion on the upstream side to an end portion on the downstream side of the material supply unit 500*a*, and the like are appropriately set in compliance with intensity of the airflow and the like.

Furthermore, the housing unit 400 has the roller 450 coming into contact with the web W and the fourth pile seal unit 440 on the downstream side in the transport direction of the web W (see FIG. 2B). Furthermore, similar to the first embodiment, it is configured such that outside air is suctioned from a sliding contact part (first pile seal unit 410 and the second pile seal unit 420) between the drum unit 300 and the housing unit 400 when suctioning the material containing the fibers by the suction device 75. The speed of the airflow in the vicinity of the first pile seal unit 410 and the second pile seal unit 420 is increased by outside air suctioned from the first pile seal unit 410 and the second pile seal unit 420. Thus, it is possible to suppress catching and aggregation of the fibers within the drum unit 300 or the housing unit 400.

According to the fourth embodiment described above, it is possible to obtain the following effects.

Air is suctioned from the outside to the inside of the housing unit 400 through the first pile seal unit 410 and the second pile seal unit 420. Thus, dispersion of the material containing the fibers is enhanced within the drum unit 300. Fiber lumps, aggregation of the fibers that are mass of the fibers, and the like are reduced within the drum unit 300 and the housing unit 400, and thus texture of the sheet is improved.

Moreover, the invention is not limited to the embodiments described above and it is possible to add various modifications and improvements to the embodiments. Modification examples are described as follows. Furthermore, each embodiment described above and each of modification examples described below may be appropriately combined.

Modification Example 1

Figure 7A:
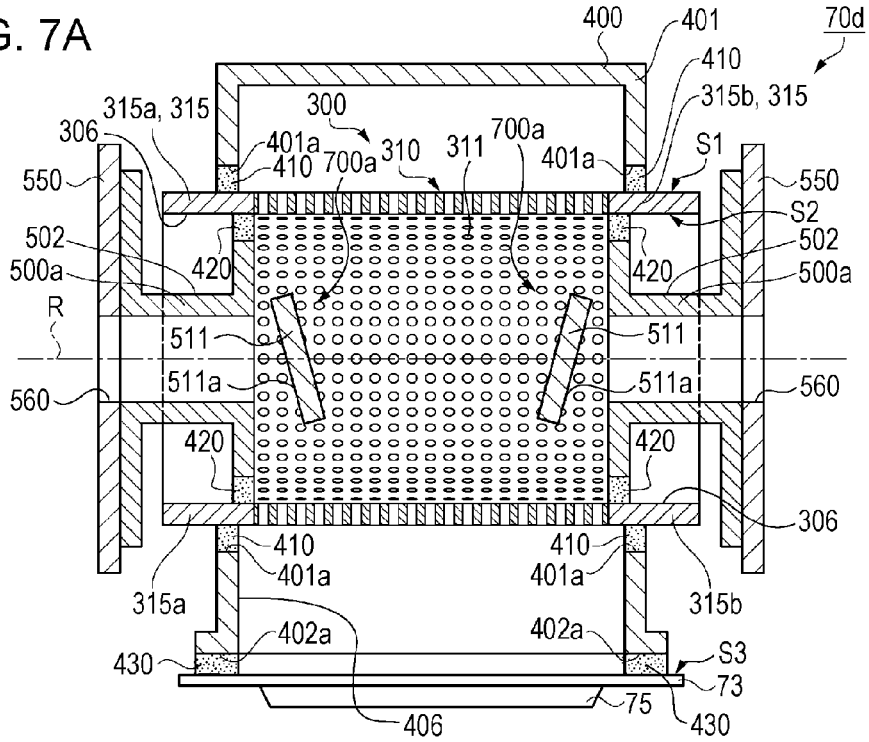
FIG. 7A is a schematic view illustrating a configuration of an accumulation unit according to Modification Example 1.
Figure 7B:
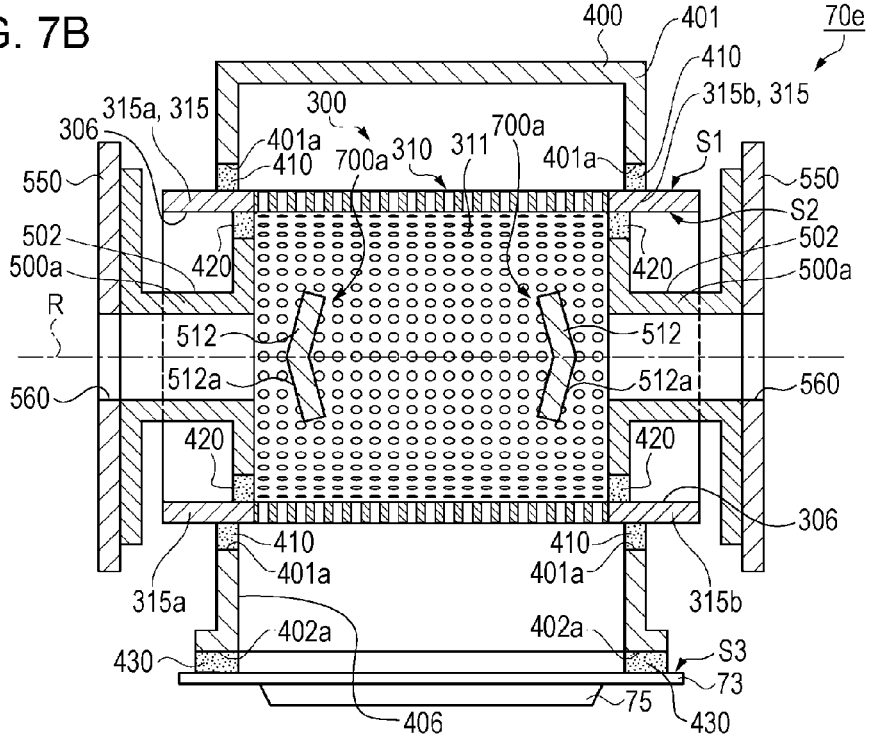
FIG. 7B is a schematic view illustrating a configuration of the accumulation unit according to Modification Example 1.

In the accumulation unit 70*a* of the second embodiment, the changing sections 510 are disposed such that the facing surfaces 510*a* of the changing sections 510 for changing the direction of the airflow are positioned in the direction substantially perpendicular to the rotation axis R of the drum unit 300, but the invention is not limited to configuration. FIGS. 7A and 7B are schematic views illustrating configurations of the accumulation unit according to Modification Example 1. As illustrated in FIG. 7A, changing sections 511 in an accumulation unit 70*d* are plate members and facing surfaces 511*a* facing the material supply ports 560 are disposed so as to incline with respect to the rotation axis R of the drum unit 300. Also, in this case, the airflow from the material supply unit 500 into the drum unit 300 collides with the changing section 511 and a direction thereof is changed and diffused on an upper side and a lower side of the drum unit 300. Thus, a dispersing effect of the material is enhanced, fiber lumps, aggregation of the fibers that are mass of the fibers, and the like are reduced within the drum unit 300, and it is possible to reduce the amount of the material containing the fibers that does not pass through the drum unit 300.

Furthermore, as illustrated in FIG. 7B, changing sections 512 in an accumulation unit 70*e* are plate members and facing surfaces 512*a* facing material supply ports 560 are bent. Also, in this case, it is possible to obtain the same effects as the above description.

Modification Example 2

Figure 8:
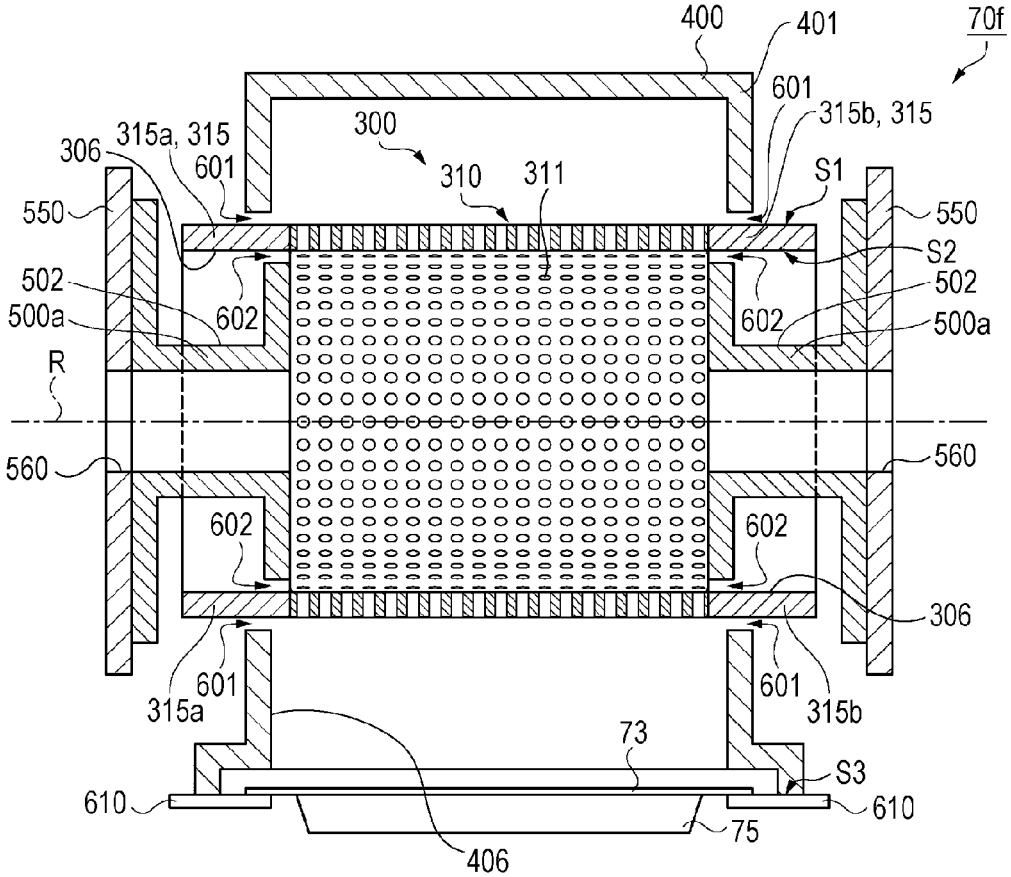
FIG. 8 is a schematic view illustrating a configuration of an accumulation unit according to Modification Example 2.

In the first to fourth embodiments described above, the first to fourth pile seal units 410, 420, 430, and 440 are provided, but the invention is not limited to the configurations. FIG. 8 is a schematic view illustrating a configuration of an accumulation unit according to Modification Example 2. As illustrated in FIG. 8, an accumulation unit 70*f* has a configuration in which a pile seal unit is omitted. Specifically, a space unit 601 is provided between a drum unit 300 and a housing unit 400, and a space unit 602 is provided between the drum unit 300 and a material supply unit 500*a*. Moreover, a lower end portion of the housing unit 400 is connected to a support unit 610 supporting both ends of a mesh belt 73. Thus, flow of air to the outside is eliminated in the lower end portion of the housing unit 400. Then, it is configured such that air flow of air suctioned by a suction device 75 is larger than air flow flowing from the material supply unit 500*a* disposed both ends of the drum unit 300 into the drum unit 300. Thus, outside air (air) is suctioned from the outside to the inside of the housing unit 400 through the space units 601 and 602. Fiber lumps, aggregation of the fibers, and the like are reduced within the drum unit 300 and the housing unit 400, and thus texture of the sheet is improved. Furthermore, it is possible to simplify the configuration of the accumulation unit 70*f* by omitting the pile seal unit.

The entire disclosure of Japanese Patent Application No. 2014-238484, filed Nov. 26, 2014 is expressly incorporated by reference herein.

What is claimed is:

1. A sheet manufacturing apparatus comprising:

a rotatable drum unit that includes an opening section having a plurality of openings on a surface thereof and a cylindrical section having no opening;

a material supply unit that is provided to supply a material containing fibers to the drum unit by airflow;

a housing unit that surrounds a periphery of the drum unit;

a suction unit that suck air within the housing below the drum unit, wherein air from outside the housing unit is suctioned into the housing through a sliding contact part between the drum unit and the housing unit by the suction unit, and a forming unit that forms a sheet by using the material passing through the openings, wherein at least one of the drum unit and the material supply unit has a diffusion section in which airflow is diffused further on a downstream side than on an upstream side in a supply direction of the airflow.

2. The sheet manufacturing apparatus according to claim 1, wherein the diffusion section is an enlarged part of which a cross-sectional area on the downstream side is greater than a cross-sectional area on the upstream side of the material supply unit.

3. The sheet manufacturing apparatus according to claim 1, wherein the diffusion section further comprises a deflecting surface that changes a direction of the airflow entering the drum unit from the material supply unit.

4. The sheet manufacturing apparatus according to claim 1, wherein a supply port of the material supply unit is positioned in a position in which the airflow is diffused with respect to the opening section within the drum unit.

5. A sheet manufacturing apparatus comprising:

a housing unit that surrounds a periphery of a drum unit; and a suction unit that sucks air within the housing unit below the drum unit, wherein air from outside the housing unit is suctioned into the housing unit through a sliding contact part between the drum unit and the housing unit during suction by the suction unit.

6. A sheet manufacturing apparatus comprising:

a rotatable drum unit that is a hollow cylindrical drum unit and includes an opening section having a plurality of openings;

a supply unit that includes a supply port for supplying a material containing fibers transported by airflow to the drum unit; and a forming unit that forms a sheet by using the material passing through the openings of the drum unit, wherein the supply port is disposed at a predetermined distance with respect to the opening section of the drum unit in a rotation axis direction of the drum unit, wherein a diameter of the supply port is smaller than an internal diameter of the drum unit, wherein the interior diameter of the drum unit is smaller than an internal diameter of the supply unit and the internal diameter of the supply unit is larger than the diameter of the supply port.

* * * * *